US006155906A

United States Patent [19]

May

[11] Patent Number: 6,155,906

[45] Date of Patent: Dec. 5, 2000

[54] GARMENTS AND GARMENT ACCESSORIES HAVING DISTINCT INTERCHANGEABLE STRAPS

[76] Inventor: Amanda May, 715 Stadium Dr., No. 1526, San Antonio, Tex. 78212

[21] Appl. No.: 09/563,708

[22] Filed: May 2, 2000

[51] Int. Cl.[7] ..... A41C 3/00

[52] U.S. Cl. ..... 450/88; 450/86; 450/1

[58] Field of Search ..... 450/1, 86, 88, 450/7–11, 17, 30, 31–33, 82, 85, 87; 2/69, 105, 106, 80, 83, 78.1

[56] References Cited

U.S. PATENT DOCUMENTS

| | | |
|---|---|---|
| 2,849,723 | 9/1958 | Marino . |
| 2,970,597 | 2/1961 | Michel . |
| 3,311,112 | 3/1967 | Murray . |
| 3,934,593 | 1/1976 | Mellinger . |
| 4,079,465 | 3/1978 | Alexander . |
| 4,416,284 | 11/1983 | Fink, IV . |
| 5,011,452 | 4/1991 | Kelly . |
| 5,171,182 | 12/1992 | Heinen . |
| 5,496,205 | 3/1996 | Lee . |
| 5,749,768 | 5/1998 | Green . |
| 5,911,618 | 6/1999 | Dailey . |
| 5,921,845 | 7/1999 | Scholtz . |

*Primary Examiner*—Gloria M. Hale
*Attorney, Agent, or Firm*—Cox & Smith Incorporated

[57] ABSTRACT

One or more undergarment foundations and a number of attachable accessory straps that together make up a garment set. The set may be purchased together and would include one or more undergarment foundation articles of clothing, such as a women's brassiere, and a number of distinct strap sets, each of the strap sets having at least one strap and preferably two. Each of the straps within a set have strap connectors at each end that are removably attachable to strap attachment points on the undergarment itself. The different strap sets within the garment set are distinct, one for the other, in that the fabrics, colors, textures, sizes, and shapes are distinct. The individual wearing one of the undergarment foundations and the associated strap accessories may choose to match an outer garment worn in conjunction with the foundation or may choose to appropriately contrast the straps of the undergarment from those of the outer garment. In any case, the wearer is able to construct these variations without the need to separately purchase many different complete undergarments.

14 Claims, 2 Drawing Sheets

GARMENTS AND GARMENT ACCESSORIES HAVING DISTINCT INTERCHANGEABLE STRAPS

BACKGROUND OF THE INVENTION

1. Field of the Invention

The present invention relates generally to garments and garment accessories. The present invention relates more specifically to shoulder straps for garments, especially for women's undergarments and the like. The invention relates to an assembly or set of garment shoulder straps that are interchangeable and distinct.

2. Description of the Related Art

Undergarments for women are manufactured and marketed in a variety of colors, fabrics and styles. The need for a variety in part relates to the variety of outer garments most often worn in conjunction with the undergarments. Frequently the outer garments do not fully and completely cover the undergarments, so it becomes necessary for the garments to appear similar or at least complimentary. This occurs most commonly with women's brassieres worn in conjunction with shirts or dresses that have shoulder straps. It is frequently impossible to keep the shoulder straps of the brassiere from being exposed under the shoulder straps of the dress or shirt. It is undesirable for these two sets of straps to be of different colors, textures or materials.

To address this problem, many women attempt to buy and wear a brassiere that matches each different shirt or dress that they own. This obviously can become expensive and impractical since the color and material array of shirts and dresses is much wider than that associated with brassieres. It would be desirable if it were possible to change the appearance of the brassiere straps without changing the entire brassiere. The same would be true for any of a number of different women's undergarments such as body briefs, camisoles and the like. It would further be desirable if the mechanisms for altering and varying the appearance of the straps on an undergarment could be readily adaptable, not only in appearance, but in the manner in which they are attached to the undergarment.

Efforts in the past to provide such versatility have been limited. Examples of patents issued in the prior art include the following:

U.S. Pat. No. 5,749,768 issued to Green on May 12, 1998 entitled ADJUSTABLE CUP BRA. This patent describes a brassiere that incorporates a number of adjustable length straps within the cup of the bra rather than over the shoulder.

U.S. Pat. No. 5,496,205 issued to Lee on Mar. 5, 1996 entitled BRASSIERE WITH CONCEALED CLOSABLE POCKETS. This patent focuses on pockets within the cups of the brassiere but does disclose connecting rings for the attachment of the shoulder straps to the cups of the bra.

U.S. Pat. No. 5,171,182 issued to Heinen on Dec. 15, 1992, entitled CAMISOLE BRASSIERE. This patent describes a brassiere with a soft camisole top that achieves support by extending the shoulder straps across the interior of the cups to be attached to the lower edge of the cups. The patent also discloses an adjustable attachment point in the shoulder straps on the back of the brassiere.

U.S. Pat. No. 5,011,452 issued to Kelly on Apr. 30, 1991 entitled BREATHABLE BRASSIERE WITH ADJUSTABLE DRAWSTRING. This patent focuses on an adjustable center drawstring that serves to form and shape the cups of the brassiere. The patent discloses and describes the common use of length-adjustment devices for changing the length of the straps.

U.S. Pat. No. 2,970,597 issued to Michel on Feb. 7, 1961 entitled BODY ENCIRCLING GARMENTS. This patent describes a front closure to a brassiere and likewise discloses adjustable attachment means for the straps of the brassiere.

U.S. Pat. No. 4,079,465 issued to Alexander on Mar. 21, 1978 entitled KITCHEN APRON WITH CHANGEABLE FRONT PANEL. This patent is drawn to an outer garment, namely an apron that is tied around the neck and which extends down to an interchangeable panel as would be typical of a kitchen apron. The purpose of the changeable front panel is to provide an easy means for altering the type of panel needed under a variety of household demands.

None of the efforts in the past have adequately addressed the need for a single undergarment foundation to which might be attached a number of distinct shoulder straps for use in conjunction with a similar variety of outer garments.

SUMMARY OF THE INVENTION

It is therefore an object of the present invention to provide an assembly or set of garment shoulder straps in conjunction with one or more foundation undergarments, such as a brassiere, that permits the selection of straps that might most appropriately be worn in conjunction with a given dress or shirt.

It is a further object of the present invention to provide one or more undergarment foundations that might be used in conjunction with a variety of shoulder straps in a variety of configurations.

It is a further object of the present invention to provide a garment set comprised of at least one undergarment foundation and a number of distinctive shoulder straps to be used with the garment foundation such that the purchaser of the set might vary the appearance of the straps with or without varying the undergarment foundation.

It is a further object of the present invention to provide a set of interchangeable undergarment straps that might be used in conjunction with one or more distinct foundation undergarments specifically designed for use with such straps and to be readily adaptable to a number of existing, commonly used, strap attachment mechanisms.

In fulfillment of these and other objectives, the present invention provides one or more undergarment foundations and a number of attachable accessory straps that together make up a garment set. The set may be purchased together and would include one or more undergarment foundation articles of clothing, such as a women's brassiere, and a number of distinct strap sets, each of the strap sets having at least one strap and preferably two. Each of the straps within a set have strap connectors at each end that are removably attachable to strap attachment points on the undergarment itself. The different strap sets within the garment set are distinct, one for the other, in that the fabrics, colors, textures, sizes, and shapes are distinct. The individual wearing one of the undergarment foundations and the associated strap accessories may choose to match an outer garment worn in conjunction with the foundation or may choose to appropriately contrast the straps of the undergarment from those of the outer garment. In any case, the wearer is able to construct these variations without the need to separately purchase many different complete undergarments.

DETAILED DESCRIPTION OF THE PREFERRED EMBODIMENTS

It is understood that though the structures of the components of the present invention lend themselves most appropriately to use in conjunction with women's brassieres and the like, other undergarments and outer garments could likewise benefit from the structures and elements described. It is anticipated that the user of the garment set described herein might choose to create matching embodiments with the set or might choose to more boldly contrast the elements within the set. The example given below, of a set as might be appropriate for use in conjunction with a women's brassiere product and the variety of straps described therewith, are intended to be exemplary of the invention, although not limiting of it.

Figure 1:
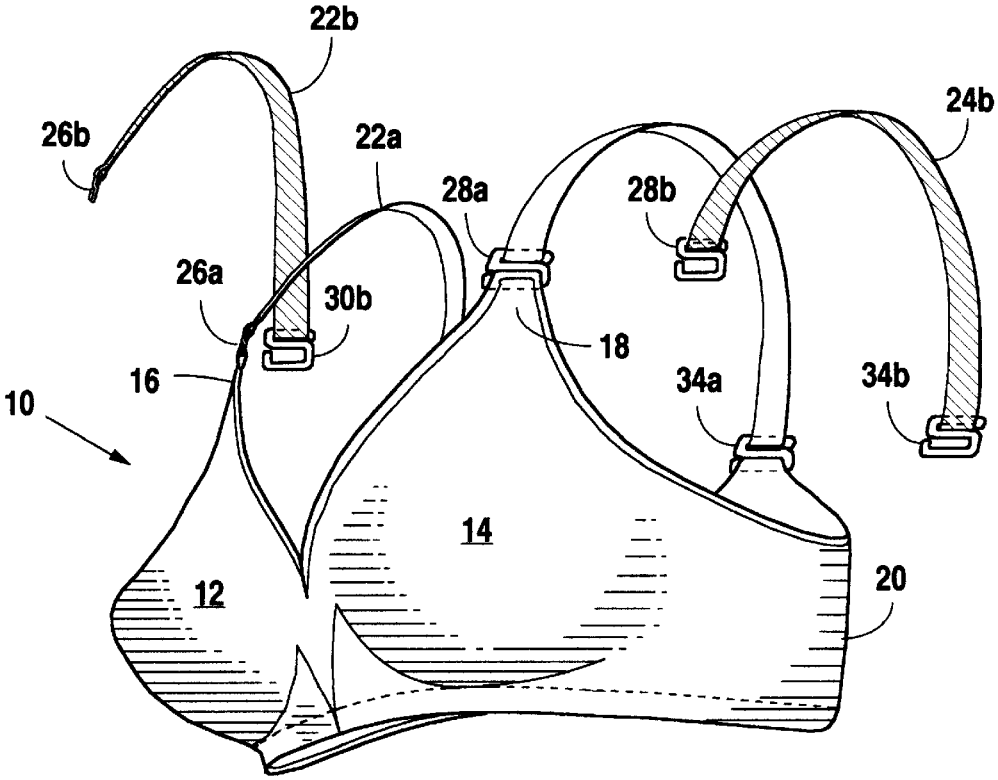
FIG. 1 is a perspective view of the assembly of the present invention used in conjunction with a brassiere.

Reference is made first to FIG. 1 for a detailed description of a basic and most appropriate use of the garment set of the present invention. In FIG. 1, brassiere 10 is shown as might typically be constructed having cups 12 and 14 and torso band 20. At some point on the upper edge of cups 12 and 14 are positioned strap attachment points 16 and 18. To these strap attachment points 16 and 18 are attached straps 22 and 24. Straps 22 and 24 also attach to attachment points (not shown) on the back of brassiere 10.

The above described basic structure of the brassiere is supplemented in the present invention by providing a plurality of alternate straps 22 and 24 and the mechanisms necessary for removing and attaching the straps to the brassiere. In FIG. 1, straps 22*a* and 24*a* might readily be replaced with straps 22*b* and 24*b*. Straps 22*a* and 24*a* each have attachment devices 26*a* and 28*a* for attachment to attachment points 16 and 18 on the front of the brassiere. Likewise, straps 22*a* and 24*a* each have attachment devices 32*a* and 34*a* for attachment to the back of the brassiere. Straps 22*b* and 24*b* have identical attachment devices 26*b*, 28*b*, 32*b* and 34*b* as shown. Straps 22*a* and 24*a* are of essentially the same material, color, texture, etc. Straps 22*b* and 24*b*, on the other hand, are constructed of a material distinctive in color, texture, fabric or size from straps 22*a* and 24*a*. This permits the wearer of brassiere 10 to choose among the various strap sets described according to the particular outer garments that the brassiere is to be worn in conjunction with.

Figure 2:
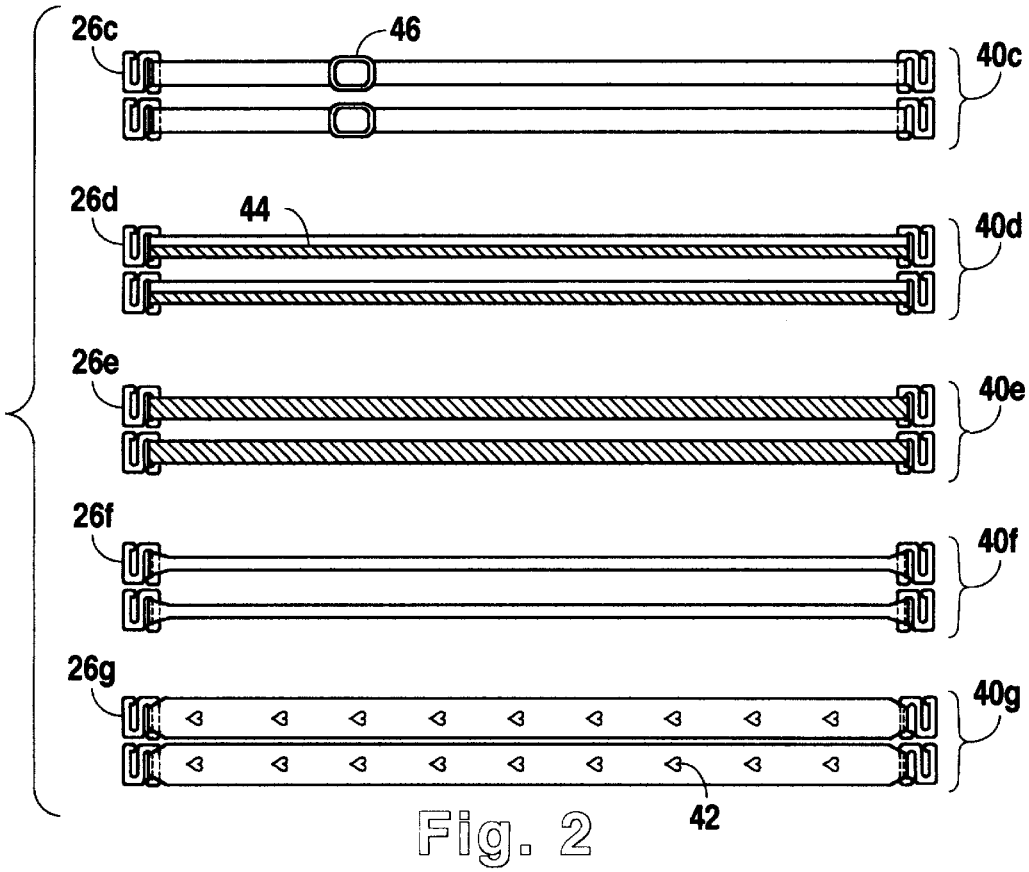
FIG. 2 is a plan view of a representative set of the garment accessories of the present invention.

Reference is now made to FIG. 2 for a representative collection of the strap sets that could be included in a garment set such as with the brassiere described above in FIG. 1. In FIG. 2, five different strap sets, 40*c* through 40*g*, are shown. It is understood that the number of different strap sets included in a garment set could be anywhere from two to dozens. The important factor is that each strap set be attachable to a single undergarment foundation thus eliminating the need to purchase a multitude of separate undergarments.

Each strap set 40*c* through 40*g* shown in FIG. 2 retains the same type of attachment devices as are necessary to attach to the single foundation undergarment. These attachment devices are typified by hooks 26*c* through 26*g* as shown. The structure of the hooks is not so important as the ability of the attachment mechanism to readily attach or be removed from the attachment points on the undergarment. The structure shown in each case herein is one such typical hook mechanism commonly associated with women's undergarments and the like. The hook mechanism permits the removable attachment of a strap to an attachment point on the undergarment without creating an uncomfortable component to the garment itself.

Strap set 40*c* shown at FIG. 2 discloses the use of an adjustment means 46 in conjunction with the straps. Adjustment means 46, is one of any of a number of devices well known in the art that can be used to adjust the overall length of the straps in strap set 40*c*.

Strap set 40*d* provides an example of straps that are in fact two contrasting strap sections connected together. This type of structure 44 may be manipulated by the wearer to create any of a number of different geometrys for each of the basic strap components.

Strap sets 40*e* and 40*f* provide examples of narrow straps as might be constructed from different colored tubular satin materials and the like. Such strap geometrys, colors and fabrics are well known in the art albeit normally associated with a specific style of brassiere.

Finally, in FIG. 2, strap set 40*g* discloses a wider strap configured to still be attached to the same sized attachment points on the undergarment. Strap set 40*g* also retains a plurality of design elements 42 that may be readily incorporated onto the structure of the strap in a manner that contributes to the overall appearance as the user might desire.

Figure 3:
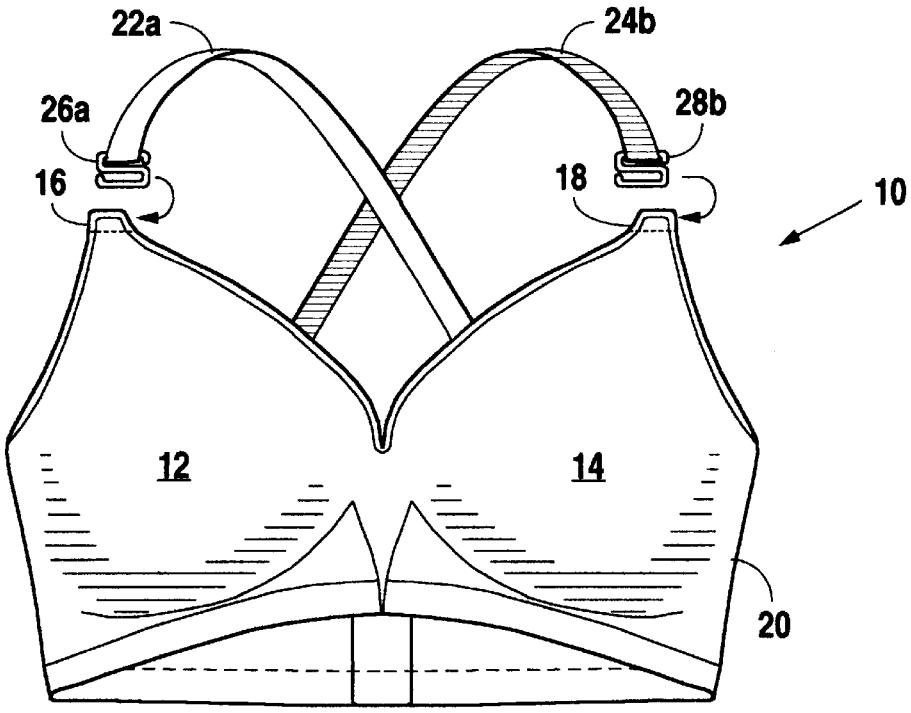
FIG. 3 is a front view of a second use of the present invention in conjunction with the brassiere shown in FIG. 1.

Reference is now made to FIG. 3 for a description of an alternate method of attaching the straps of the present invention to the foundation garment. In FIG. 3, the same brassiere 10 shown in FIG. 1 is utilized in conjunction with straps 22*a* and 24*b*. The same attachments described above are shown. In this case, however, the straps 22*a* and 24*b* are crossed in the back and may readily be attached to the opposing attachment points on the back of the brassiere 10. Although this structure in of itself is not unique, the present invention permits this cross over of straps to be accomplished both with straps of a similar construction or straps of distinctive constructions. In the example shown in FIG. 32, strap 22*a* is of a first structural characteristic, while strap 24*b* is of a distinctive structural characteristic. It is anticipated that these distinctions would be appropriately contrasting as chosen by the wearer.

Figure 4:
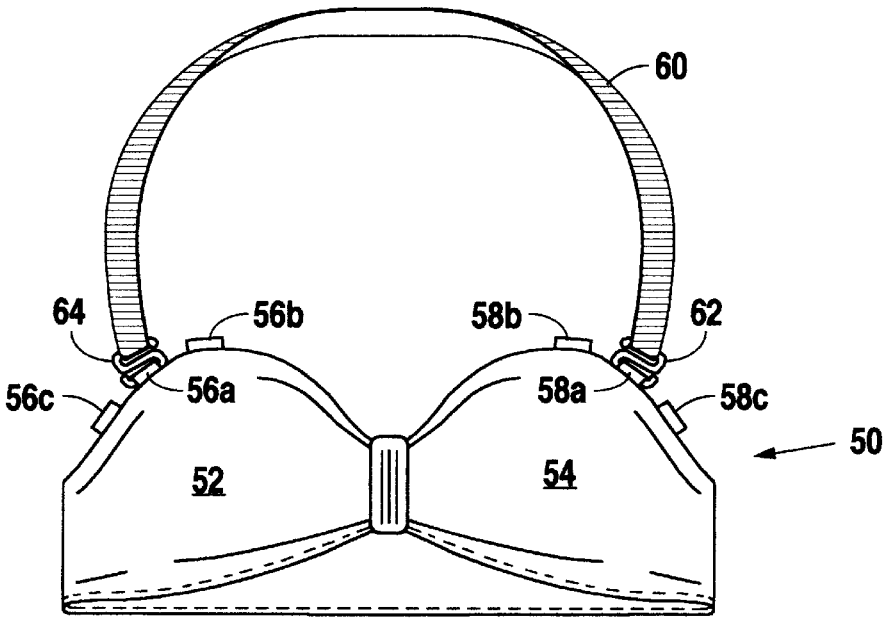
FIG. 4 is a front view of a third use of the present invention in conjunction with an alternate style of brassiere.

Reference is finally made to FIG. 4 for a brief description of yet another use of the present invention in conjunction with well-known undergarment constructions and methods of use. In FIG. 4 a tube type brassiere 50 is disclosed having cups 52 and 54 formed by a partial gathering of the material of the brassiere at a center point. Strap attachment points 56*a* and 58*a* are positioned near the tops of the cups 52 and 54. In this embodiment, a single strap 60 is attached between attachment points 56 and 58 through the use of attachment devices 62 and 64. In this manner, the strap sets of the present invention may be used to create a halter type brassiere commonly worn in conjunction with backless dresses and the like. In addition, the strap sets of the present invention lend themselves to use in conjunction with the brassiere type shown in FIG. 4 in a two-strap manner as is traditional.

Although one benefit of the present invention is the elimination of the need to purchase many different brassieres and the like, it is anticipated that a possible garment set could include more than one type of foundation. It would be desirable, as an example, to include both the type of brassiere shown in FIG. 1 and the type shown in FIG. 4, each of which could match with the strap sets described.

The strap attachment points positioned on the foundation undergarment may also be any of a number of well-known mechanisms for retaining straps. Most commonly, the fabric of the foundation undergarment is folded and sewn in such a manner as to provide a slot or short tubular opening into which the strap attachment device may be slid. This structure provides the least intrusive mechanism for the wearer of the garment. In addition, as shown in FIG. 4, multiple attachment points 56*b*, 56*c*, 58*b* and 58*c* could be incorporated on the cups of the foundation. In this manner, the wearer may alter the placement of the straps so as to best suit the cut of the dress or shirt being worn with the undergarment. Many different attachment mechanisms and attachment point structures are anticipated for use in conjunction with basic elements and components of the present invention.

As indicated above, a variety of foundation undergarments and a variety of similarly structured outer garments could readily incorporate the basic concepts of the present invention. It is anticipated that a basic garment set incorporating the components of the present invention would include one or more foundation garments and as many as eight to twelve strap sets of different colors, textures and the like. The most common color combinations would include, white, black, beige or brown and red. Of course, the range of colors possible for use in conjunction with the present invention is not limited. Likewise, significant variation could occur in the fabric utilized for the various strap sets in a given garment set. Most commonly, a variety of satin straps would be constructed ranging in size from thin, tubular straps to wide flat straps. Textures for the fabric of the straps would generally be limited only by those that remain comfortable for the wearer. It is anticipated that some undergarments, such as sports brassieres, would preferably be used in conjunction with wide flat straps that provide the comfort and support necessary for athletic activities. The only constraint on the size and geometry of the straps and the materials from which they are constructed is that a consistent strap attachment mechanism, such as that shown in the attached figures, might be readily attached to the strap. While the preferred embodiment discloses the strap attachment mechanisms incorporated onto the straps themselves, it is possible that the strap attachment mechanisms could be incorporated onto the foundation garment instead. Such an arrangement would not be appropriate; however, where the foundation garment might also be used as a strapless garment, without the straps provided in the garment set.

Many other variations of the basic arrangements described and disclosed herein are anticipated. Those skilled in the art will recognize substitutions for both the straps and the foundation garment of the present invention that might still retain and utilize the basic precepts of the invention.

I claim:

1. An undergarment and a plurality of attachable accessories, the undergarment and accessories comprising a garment set, the garment set comprising:

an undergarment article of clothing for partially covering the upper torso of a wearer, the undergarment configured to receive and retain at least one strap at a plurality of strap attachment points; and a plurality of strap sets, each of said strap sets comprising at least one strap, each of said straps having first and second strap connectors positioned at first and second ends of said straps, said strap connectors removably attachable to said strap attachment points on said undergarment, each of said strap sets comprising a material characteristically distinct from a material of every other strap set;

wherein straps from one of said plurality of strap sets may be interchanged with distinct straps from a second of said plurality of strap sets to provide a distinct exposed portion of said undergarment when worn in conjunction with an outer garment.

2. The garment set of claim 1 wherein said undergarment is a women's brassiere and said strap sets each comprise a pair of shoulder straps for maintaining said brassiere in place.

3. The garment set of claim 1 wherein each of said plurality of strap sets comprise two straps and said plurality of strap attachment points on said undergarment comprise two attachment points on a front section of said undergarment and two attachment points on a back section of said undergarment.

4. The garment set of claim 1 wherein said characteristically distinct materials comprise distinctions in at least one of the following characteristics; color, fabric composition, strap width, and texture.

5. A garment and a plurality of attachable accessories, the garment and accessories comprising a garment set, the garment set comprising:

an article of clothing for partially covering the upper torso of a wearer, the article of clothing configured to receive and retain at least one strap at a plurality of strap attachment points; and a plurality of strap sets, each of said strap sets comprising at least one strap, each of said straps having first and second strap connectors positioned at first and second ends of said straps, said strap connectors removably attachable to said strap attachment points on said article of clothing, each of said strap sets comprising a material characteristically distinct from a material of every other strap set;

wherein straps from one of said plurality of strap sets may be interchanged with distinct straps from a second of said plurality of strap sets.

6. A brassiere and straps garment set, the garment set comprising:

a brassiere foundation, said foundation configured to receive and retain at least one strap at least two strap attachment points; and a plurality of shoulder strap sets, each of said strap sets comprising two straps, each of said straps having first and second strap connectors positioned at first and second ends of said straps, said strap connectors removably attachable to said strap attachment points on said brassiere, each of said strap sets comprising a material characteristically distinct from a material of every other strap set;

wherein straps from one of said plurality of strap sets may be interchanged with distinct straps from a second of said plurality of strap sets to provide a distinct exposed portion of said brassiere when worn in conjunction with an outer garment.

7. The garment set of claim 6 wherein said characteristically distinct materials comprise distinctions in at least one of the following characteristics; color, material composition, strap width and texture.

8. The garment set of claim 6 wherein said plurality of strap sets comprises at least one strap set having straps comprising flat lengths of fabric having a width in the range of 0.5 inch to 1.0 inch.

9. The garment set of claim 6 wherein said plurality of strap sets comprises at least one strap set having straps comprising flat lengths of fabric having a width in the range of 1.0 inch to 3.0 inches.

10. The garment set of claim 6 wherein said plurality of strap sets comprises at least one strap set having straps comprising tubular lengths of fabric having a diameter in the range of 0.1 inch to 0.5 inch.

11. The garment set of claim 6 wherein said plurality of strap sets comprises at least one strap set having straps comprising transparent material.

12. The garment set of claim 6 wherein said plurality of strap sets comprises at least one strap set having straps each comprising multiple strands of material connected together at first and second ends thereof.

13. The garment set of claim 8 wherein said first and second strap connectors positioned at first and second ends of said straps comprising flat lengths of fabric having a width in the range of 1.0 inch to 3.0 inches each comprise two component connectors positioned adjacent each other on said ends of said straps and said four strap attachment points each comprise two receptors for receiving said two component connectors.

14. The garment set of claim 6 wherein said at least two strap attachment points comprise at least two groups of adjacent attachment points, said adjacent attachment points allowing placement of said straps at offset alternative positions on said brassiere foundation.

* * * * *

US006155906C1

(12) INTER PARTES REEXAMINATION CERTIFICATE (0353rd)

United States Patent

May

(10) Number: US 6,155,906 C1

(45) Certificate Issued: Mar. 13, 2012

(54) GARMENTS AND GARMENT ACCESSORIES HAVING DISTINCT INTERCHANGEABLE STRAPS

(75) Inventor: Amanda May, San Antonio, TX (US)

(73) Assignee: Amanda May, San Antonio, TX (US)

Reexamination Request:
No. 95/000,065, Dec. 8, 2004

Reexamination Certificate for:

| | |
|---|---|
| Patent No.: | **6,155,906** |
| Issued: | **Dec. 5, 2000** |
| Appl. No.: | **09/563,708** |
| Filed: | **May 2, 2000** |

(51) Int. Cl.
*A41C 3/00* (2006.01)

(52) U.S. Cl. ..... 450/88; 450/86; 450/1

(58) Field of Classification Search ..... None
See application file for complete search history.

(56) References Cited

To view the complete listing of prior art documents cited during the proceeding for Reexamination Control Number 95/000,065, please refer to the USPTO's public Patent Application Information Retrieval (PAIR) system under the Display References tab.

*Primary Examiner*—Jeffrey R. Jastrzab

(57) ABSTRACT

One or more undergarment foundations and a number of attachable accessory straps that together make up a garment set. The set may be purchased together and would include one or more undergarment foundation articles of clothing, such as a women's brassiere, and a number of distinct strap sets, each of the strap sets having at least one strap and preferably two. Each of the straps within a set have strap connectors at each end that are removably attachable to strap attachment points on the undergarment itself. The different strap sets within the garment set are distinct, one for the other, in that the fabrics, colors, textures, sizes, and shapes are distinct. The individual wearing one of the undergarment foundations and the associated strap accessories may choose to match an outer garment worn in conjunction with the foundation or may choose to appropriately contrast the straps of the undergarment from those of the outer garment. In any case, the wearer is able to construct these viarations without the need to separately purchase many different complete undergarments.

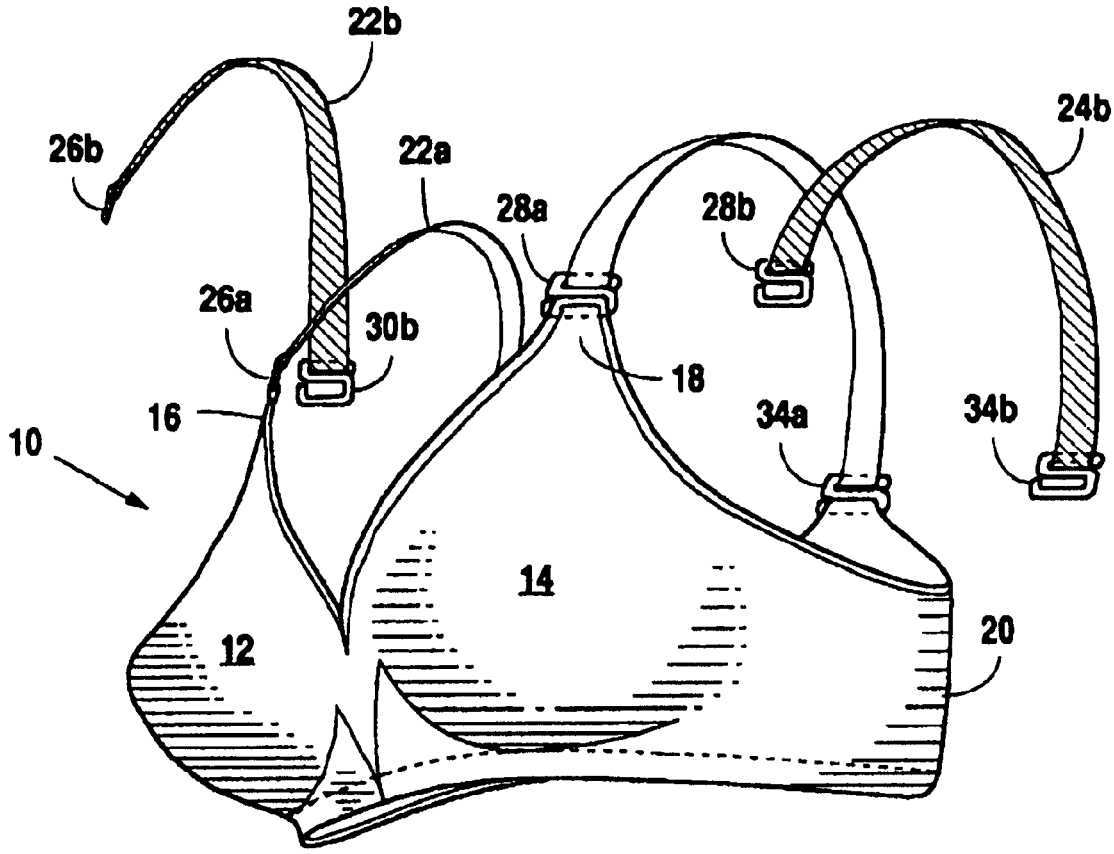

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-14 are cancelled.

New claims 15-35 were cancelled.

* * * * *